US011264159B2

(12) United States Patent
Murakami

(10) Patent No.: US 11,264,159 B2
(45) Date of Patent: Mar. 1, 2022

(54) COMMON MODE CHOKE COIL

(71) Applicant: Murata Manufacturing Co., Ltd., Kyoto-fu (JP)

(72) Inventor: Naoyuki Murakami, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 479 days.

(21) Appl. No.: 16/264,076

(22) Filed: Jan. 31, 2019

(65) Prior Publication Data

US 2019/0244741 A1 Aug. 8, 2019

(30) Foreign Application Priority Data

Feb. 7, 2018 (JP) ..... JP2018-020113

(51) Int. Cl.
*H01F 17/00* (2006.01)
*H01F 27/29* (2006.01)

(52) U.S. Cl.
CPC ..... *H01F 17/0013* (2013.01); *H01F 27/29* (2013.01); *H01F 2017/002* (2013.01);
(Continued)

(58) Field of Classification Search
CPC ..... H01F 17/0013; H01F 2027/2809; H01F 17/006; H01F 27/2804; H01F 5/003;
(Continued)

(56) References Cited

U.S. PATENT DOCUMENTS

2003/0134612 A1* 7/2003 Nakayama ..... H01F 17/0013 455/307
2016/0133374 A1* 5/2016 Inui ..... H01F 27/292 336/192
2019/0051440 A1 2/2019 Ueki

FOREIGN PATENT DOCUMENTS

CN 1425183 A 6/2003
CN 105590733 A 5/2016
(Continued)

OTHER PUBLICATIONS

An Office Action issued by the China National Intellectual Property Administration dated Aug. 18, 2020, which corresponds to Chinese Patent Application No. 201910106962.8 and is related to U.S. Appl. No. 16/264,076 with English language translation.
(Continued)

*Primary Examiner* — Tszfung J Chan
(74) *Attorney, Agent, or Firm* — Studebaker & Brackett PC

(57) ABSTRACT

A common mode choke coil includes a multilayer body obtained by stacking insulating layers, first and second coils inside the multilayer body, and first to fourth outer electrodes on outer surfaces of the multilayer body. The first and second outer electrodes are respectively connected to first and second ends of the first coil. The third and fourth outer electrodes are respectively connected to first and second ends of the second coil. The first coil includes first to third spiral conductors connected to one another through via conductors. The second coil includes fourth to sixth spiral conductors connected to one another through via conductors. The first spiral conductor is adjacent to the second and fourth spiral conductors. The fourth spiral conductor is adjacent to the first and fifth spiral conductors. The distance between the first and fourth spiral conductors is smaller than the distances between other spiral conductors.

11 Claims, 5 Drawing Sheets

(52) U.S. Cl.
CPC ..... *H01F 2017/0066* (2013.01); *H01F 2017/0093* (2013.01)

(58) Field of Classification Search
CPC ..... H01F 2017/002; H01F 2017/0093; H01F 27/29; H01F 27/292
USPC ..... 336/200, 232
See application file for complete search history.

(56) References Cited

FOREIGN PATENT DOCUMENTS

| | | | | |
|---|---|---|---|---|
| JP | 2001-044033 | A | | 2/2001 |
| JP | 2005-223261 | A | | 8/2005 |
| JP | 2005223261 | A | * | 8/2005 |
| JP | 2008-072071 | A | | 3/2008 |
| JP | 2016-092322 | A | | 5/2016 |
| WO | 0167470 | A1 | | 9/2001 |
| WO | 2018/012400 | A1 | | 1/2018 |

OTHER PUBLICATIONS

An Office Action; "Notification of Reasons for Refusal," mailed by the Japanese Patent Office dated Mar. 10, 2020, which corresponds to Japanese Patent Application No. 2018-020113 and is related to U.S. Appl. No. 16/264,076 with English language translation.

* cited by examiner

COMMON MODE CHOKE COIL

CROSS-REFERENCE TO RELATED APPLICATION

This application claims benefit of priority to Japanese Patent Application No. 2018-020113, filed Feb. 7, 2018, the entire content of which is incorporated herein by reference.

BACKGROUND

Technical Field

The present disclosure relates to a common mode choke coil.

Background Art

Common mode choke coils are used to reject common mode noise that can occur in internal circuits of electronic appliances. Japanese Unexamined Patent Application Publication No. 2001-44033 describes a multilayer common mode choke coil, in which a first coil is formed by forming a spiral conductor pattern having one or more turns on each of insulating layers, stacking the resulting insulating layers, and connecting the conductor patterns by using through holes, a second coil is formed by forming a spiral conductor pattern having one or more turns on each of insulating layers, stacking the resulting insulating layers, and connecting the conductor patterns by using through holes, and the insulating layers for the first coil and the insulating layers for the second coil are alternately stacked. The center position of a through hole that connects the spiral conductor patterns is shifted inward or outward from a continuous line extending from a center line of the spiral conductor pattern immediately in front of the through hole.

SUMMARY

As electronic appliances become increasingly high-speed and multifunctional, demand for common mode choke coils having high common mode impedances and high cut-off frequencies has grown. However, existing common mode choke coils tend to have low cut-off frequencies when the common mode impedance is increased, and it has been difficult to achieve both a high common mode impedance and a high cut-off frequency.

It is desirable to provide a common mode choke coil that has a high common mode impedance and a high cut-off frequency. The inventor of the present disclosure has found that a common mode choke coil that has a high common mode impedance and a high cut-off frequency can be obtained by decreasing the distance between spiral conductors in a portion where coupling between a primary coil and a secondary coil is strong, and thus made the present disclosure.

An aspect of the present disclosure provides a common mode choke coil including a multilayer body obtained by stacking a plurality of insulating layers; a first coil and a second coil disposed inside the multilayer body; and a first outer electrode, a second outer electrode, a third outer electrode, and a fourth outer electrode disposed on outer surfaces of the multilayer body. The first outer electrode and the second outer electrode are respectively electrically connected to a first end and a second end of the first coil. The third outer electrode and the fourth outer electrode are respectively electrically connected to a first end and a second end of the second coil. The first coil includes at least a first spiral conductor, a second spiral conductor, and a third spiral conductor that are connected to one another in a stacking direction of the multilayer body through via conductors. The second coil includes at least a fourth spiral conductor, a fifth spiral conductor, and a sixth spiral conductor that are connected to one another in the stacking direction of the multilayer body through via conductors. In the stacking direction, the first spiral conductor is adjacent to the second spiral conductor and the fourth spiral conductor, and the fourth spiral conductor is adjacent to the first spiral conductor and the fifth spiral conductor. Among distances between the spiral conductors adjacent in the stacking direction, a distance between the first spiral conductor and the fourth spiral conductor is smaller than other distances.

The common mode choke coil according to an aspect of the present disclosure and having the aforementioned features has a high common mode impedance and a high cut-off frequency.

Other features, elements, characteristics and advantages of the present disclosure will become more apparent from the following detailed description of preferred embodiments of the present disclosure with reference to the attached drawings.

DETAILED DESCRIPTION

Figure 1:
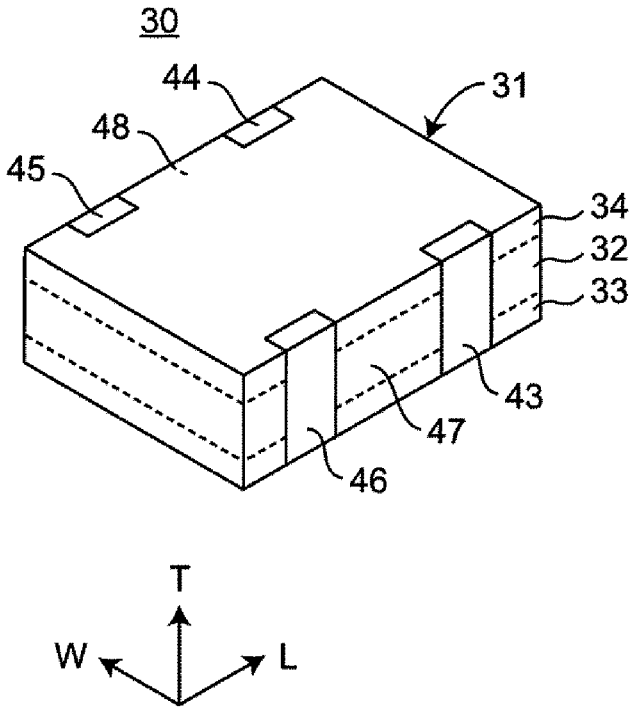
FIG. 1 is a schematic perspective view of a common mode choke coil according to a first embodiment of the present disclosure.

The embodiments of the present disclosure will now be described with reference to the drawings. The embodiments described below are for the illustrative purposes and do not limit the scope of the present disclosure. The dimensions, materials, shapes, relative positions, etc., of the constituent elements described below are merely illustrative examples and do not limit the scope of the present disclosure unless otherwise specified. Furthermore, the size, shapes, positional relationships, etc., of the constituent elements illustrated in the drawings are sometimes exaggerated to simplify the illustration.

First Embodiment

A schematic perspective view of a common mode choke coil 30 according to a first embodiment of the present disclosure is shown in FIG. 1. The common mode choke coil 30 of the first embodiment includes a multilayer body 31 including a plurality of insulating layers stacked on top of each other, a first coil and a second coil disposed inside the multilayer body 31, and a first outer electrode 43, a second outer electrode 44, a third outer electrode 45, and a fourth outer electrode 46 disposed on outer surfaces of the multilayer body 31. In this description, the length, the width, and the thickness (height) of the common mode choke coil 30 may be respectively referred to as "L", "W", and "T" (see FIG. 1). In this description, the direction parallel to the length L of the multilayer body 31 may be referred to as the "L direction", the direction parallel to the width W may be referred to as the "W direction", and the direction parallel to the thickness T may be referred to as the "T direction". A surface parallel to the L direction and the T direction may be referred to as the "LT surface", a surface parallel to the W direction and the T direction may be referred to as the "WT surface", and a surface parallel to the L direction and the W direction may be referred to as the "LW surface".

In the structure illustrated in FIG. 1, the multilayer body 31 has a structure that includes a glass ceramic layer 32 sandwiched between two ferrite layers 33 and 34. Alternatively, in this embodiment, the multilayer body 31 may be formed solely of the glass ceramic layer 32, or may further include an additional glass ceramic layer on a lower surface side of the ferrite layer 33 and an additional glass ceramic layer on an upper surface side of the ferrite layer 34. Alternatively, the multilayer body 31 may further include an additional glass ceramic layer on a lower surface side of the ferrite layer 33, another additional glass ceramic layer on an upper surface side of the ferrite layer 34, and additional ferrite layers on a lower surface side and an upper surface side of the additional glass ceramic layers, respectively.

The glass ceramic layer 32 is formed of a glass ceramic material. In order to obtain satisfactory high-frequency characteristics, a glass ceramic material is preferably used. In this case, a borosilicate glass mainly composed of Si and B is preferably used. For example, a borosilicate glass having a composition of $SiO_2$: 70 wt % or more and 85 wt % or less (i.e., from 70 wt % to 85 wt %), $B_2O_3$: 10 wt % or more and 25 wt % or less (i.e., from 10 wt % to 25 wt %), $K_2O$: 0.5 wt % or more and 5 wt % or less (i.e., from 0.5 wt % to 5 wt %), and $Al_2O_3$: 0 wt % or more and 5 wt % or less (i.e., from 0 wt % to 5 wt %) can be used. The glass ceramic layer 32 may further contain a non-magnetic material such as a Cu—Zn ferrite or a magnetic material such as a Ni—Cu—Zn ferrite. For example, the glass ceramic layer 32 may be formed of a magnetic material composed of a composite material containing a glass ceramic material and a Ni—Cu—Zn ferrite material.

When the glass ceramic layer 32 contains a borosilicate glass, the glass ceramic layer 32 preferably further contains about 2 wt % or more and 30 wt % or less (i.e., from about 2 wt % to 30 wt %) of a filler component, such as quartz ($SiO_2$), forsterite (2 $MgO \cdot SiO_2$), and alumina ($Al_2O_3$). A borosilicate glass has a low relative permittivity, and satisfactory high-frequency characteristics can be obtained. Furthermore, since quartz has a relative permittivity lower than the borosilicate glass, addition of quartz can further improve the high-frequency characteristics. Moreover, since forsterite and alumina have high bending strength, adding these can improve the mechanical strength.

Examples of the material constituting the ferrite layers 33 and 34 include magnetic materials, such as Ni—Cu—Zn ferrite materials, and nonmagnetic materials, such as Cu—Zn ferrite materials. When the ferrite layers 33 and 34 are formed of a magnetic material, namely, a Ni—Cu—Zn ferrite, the inductance (L) of the common mode choke coil can be increased. When the ferrite layers 33 and 34 are formed of a nonmagnetic material, the mechanical strength of the common mode choke coil can be improved. As the Ni—Cu—Zn ferrite, the one having a composition of $Fe_2O_3$: 40 mol % or more and 49.5 mol % or less (i.e., from 40 mol % to 49.5 mol %), ZnO: 5 mol % or more and 35 mol % or less (i.e., from 5 mol % to 35 mol %), CuO: 4 mol % or more and 12 mol % or less (i.e., from 4 mol % to 12 mol %), and the balance: NiO and trace additives (including unavoidable impurities) can be used. In this embodiment, the ferrite layers 33 and 34 are not essential.

When the multilayer body 31 further includes a glass ceramic layer on a lower surface side of the ferrite layer 33 and a glass ceramic layer on an upper surface side of the ferrite layer 34, structural defects, such as separation between the glass ceramic layer 32 and the ferrite layer 33 and between the glass ceramic layer 32 and the ferrite layer 34, can be suppressed. These additional glass ceramic layers are preferably formed of the same material as the glass ceramic layer 32. In this embodiment, the additional glass ceramic layers on the lower surface side and the upper surface side of the ferrite layer 33 and the ferrite layer 34, respectively, are not essential.

When the multilayer body 31 further includes additional glass ceramic layers on a lower surface side of the ferrite layer 33 and on an upper surface side of the ferrite layer 34, respectively, and additional ferrite layers on a lower surface side and an upper surface side of these additional glass ceramic layers, respectively, the flexural strength of the multilayer body 31 can be improved. These additional ferrite layers are preferably formed of the same material as the ferrite layers 33 and 34. In this embodiment, these additional ferrite layers are not essential.

The first outer electrode 43, the second outer electrode 44, the third outer electrode 45, and the fourth outer electrode 46 are formed on the outer surfaces of the multilayer body 31. Specifically, the first outer electrode 43 and the fourth outer electrode 46 are located at a side surface 47 of the multilayer body 31, and the second outer electrode 44 and the third outer electrode 45 are located at a side surface 48 facing the side surface 47. The outer electrodes 43 to 46 can be formed of a conductor material such as a metal such as Cu, Pd, Al, or Ag or an alloy thereof. The first outer electrode 43 and the second outer electrode 44 are respectively electrically connected to a first end and a second end of the first coil, and the third outer electrode 45 and the fourth outer electrode 46 are respectively electrically connected to a first end and a second end of the second coil.

Figure 2:
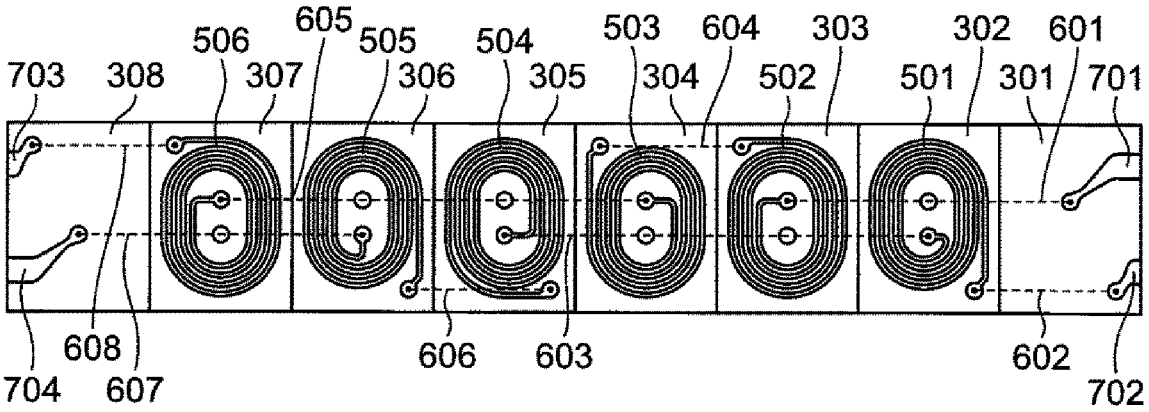
FIG. 2 is a schematic diagram illustrating one example of an internal structure of a multilayer body in the common mode choke coil of the first embodiment.

One example of an internal structure of the multilayer body in the common mode choke coil of the first embodiment is schematically illustrated in FIG. 2. The glass ceramic layer 32 has a multilayer structure constituted by a stack of insulating layers that include eight insulating layers 301 to 308 illustrated in FIG. 2. The insulating layers may each be formed of a single insulator sheet, or multiple insulator sheets may be stacked to serve as one insulating layer. The insulating layers 301 to 308 are stacked in this order from the bottom. Spiral conductors 501 to 506 are respectively formed on the insulating layers 302 to 307. The spiral conductors 501 to 506 each have an inner peripheral end portion, which is located relatively near the center of the corresponding one of the insulating layers 302 to 307, and an outer peripheral end portion, which is located relatively near the outer periphery. The spiral conductors 501 to 506 are actually formed to extend along the interfaces between the adjacent insulating layers 301 to 308; however, for the purpose of the description, the spiral conductors 501 to 506 are assumed to be disposed on the insulating layers 302 to 307.

A first coil and a second coil are formed inside the multilayer body 31, more specifically, inside the glass ceramic layer 32. The first coil includes at least a first spiral conductor, a second spiral conductor, and a third spiral conductor that are connected to one another through via conductors in the stacking direction of the multilayer body 31. The second coil includes at least a fourth spiral conductor, a fifth spiral conductor, and a sixth spiral conductor that are connected to one another through via conductors in the stacking direction of the multilayer body 31. In the example illustrated in FIG. 2, the first coil includes spiral conductors 501, 504, and 505 and via conductors 603 and 606, and the second coil includes spiral conductors 502, 503, and 506 and via conductors 604 and 605. The first coil further includes an extended conductor 702 electrically connected to the second outer electrode 44, a via conductor 602 connecting the extended conductor 702 to the spiral conductor 501, an extended conductor 704 electrically connected to the first outer electrode 43, and a via conductor 607 connecting the extended conductor 704 to the spiral conductor 505. The second coil further includes an extended conductor 701 electrically connected to the third outer electrode 45, a via conductor 601 connecting the extended conductor 701 to the spiral conductor 502, an extended conductor 703 electrically connected to the fourth outer electrode 46, and a via conductor 608 connecting the extended conductor 703 to the spiral conductor 506.

First, the connection configuration of the spiral conductors 501, 504, and 505 constituting the first coil is described. The description is provided in the order of stacking from the bottom. That is, the outer peripheral end portion of the spiral conductor 501 formed on the insulating layer 302 is connected to the extended conductor 702 formed on the insulating layer 301 through the via conductor 602 penetrating through the insulating layer 302. The extended conductor 702 is extended as far as the outer peripheral edge of the insulating layer 301. Meanwhile, the inner peripheral end portion of the spiral conductor 501 is connected to the via conductor 603 penetrating through the insulating layers 303, 304, and 305.

Next, the via conductor 603 is connected to the inner peripheral end portion of the spiral conductor 504 formed on the insulating layer 305. As a result, the inner peripheral end portion of the spiral conductor 501 and the inner peripheral end portion of the spiral conductor 504 are connected to each other through the via conductor 603. The outer peripheral end portion of the spiral conductor 504 is connected to the via conductor 606 penetrating through the insulating layer 306.

Next, the via conductor 606 is connected to the outer peripheral end portion of the spiral conductor 505 formed on the insulating layer 306. As a result, the outer peripheral end portion of the spiral conductor 504 and the outer peripheral end portion of the spiral conductor 505 are connected to each other through the via conductor 606. The inner peripheral end portion of the spiral conductor 505 is connected to the via conductor 607 penetrating through the insulating layers 307 and 308.

Next, the via conductor 607 is connected to the extended conductor 704 formed on the insulating layer 308, and the extended conductor 704 is extended as far as the outer peripheral edge of the insulating layer 308.

As described above, the first coil is formed by connecting the spiral conductors 501, 504, and 505 sequentially through the via conductors 603 and 606.

Next, the connection configuration of the spiral conductors 502, 503, and 506 constituting the second coil is described. The description is provided in the order of stacking from the bottom. That is, the inner peripheral end portion of the spiral conductor 502 formed on the insulating layer 303 is connected to the extended conductor 701 formed on the insulating layer 301 through the via conductor 601 penetrating through the insulating layers 303 and 302. The extended conductor 701 is extended as far as the outer peripheral edge of the insulating layer 301. Meanwhile, the outer peripheral end portion of the spiral conductor 502 is connected to the via conductor 604 penetrating through the insulating layer 304.

Next, the via conductor 604 is connected to the outer peripheral end portion of the spiral conductor 503 formed on the insulating layer 304. As a result, the outer peripheral end portion of the spiral conductor 502 and the outer peripheral end portion of the spiral conductor 503 are connected to each other through the via conductor 604. The inner peripheral end portion of the spiral conductor 503 is connected to the via conductor 605 penetrating through the insulating layers 305, 306, and 307.

Next, the via conductor 605 is connected to the inner peripheral end portion of the spiral conductor 506 formed on the insulating layer 307. As a result, the inner peripheral end portion of the spiral conductor 503 and the inner peripheral end portion of the spiral conductor 506 are connected to each other through the via conductor 605. The outer peripheral end portion of the spiral conductor 506 is connected to the via conductor 608 penetrating through the insulating layer 308.

Next, the via conductor 608 is connected to the extended conductor 703 formed on the insulating layer 308, and the extended conductor 703 is extended as far as the outer peripheral edge of the insulating layer 308.

As described above, the second coil is formed by connecting the spiral conductors 502, 503, and 506 sequentially through the via conductors 604 and 605.

Examples of the conductor material contained in the spiral conductors 501 to 506, the via conductors 601 to 608, and the extended conductors 701 to 704 include conductive metals, such as Cu, Pd, Al, and Ag, and alloys thereof.

Figure 3:
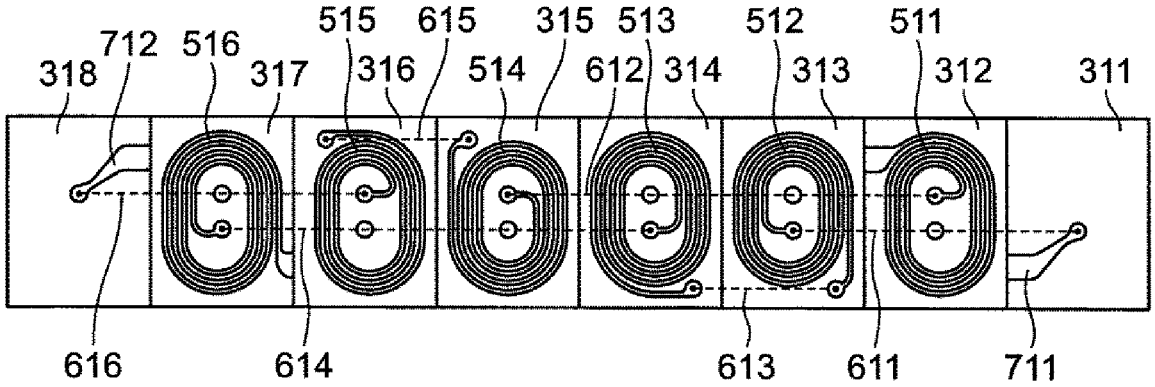
FIG. 3 is a schematic diagram illustrating another example of the internal structure of the multilayer body in the common mode choke coil of the first embodiment.

Another example of the internal structure of the multilayer body in the common mode choke coil of the first embodiment is schematically illustrated in FIG. 3. The glass ceramic layer 32 has a multilayer structure constituted by a stack of insulating layers that include eight insulating layers 311 to 318 illustrated in FIG. 3. The insulating layers 311 to 318 are stacked in this order from the bottom. Spiral conductors 511 to 516 are respectively formed on the insulating layers 312 to 317. The spiral conductors 511 to 516 each have an inner peripheral end portion, which is located relatively near the center of the corresponding one of the insulating layers 312 to 317, and an outer peripheral end portion, which is located relatively near the outer periphery. The spiral conductors 511 to 516 are actually formed to extend along the interfaces between the adjacent insulating layers 311 to 318; however, for the purpose of the description, the spiral conductors 511 to 516 are assumed to be disposed on the insulating layers 312 to 317.

In the example illustrated in FIG. 3, the first coil includes spiral conductors 511, 514, and 515 and via conductors 612 and 615, and the second coil includes spiral conductors 512, 513, and 516 and via conductors 611, 613, and 614. The first coil further includes an extended conductor 712 electrically connected to the first outer electrode 43, and a via conductor 616 connecting the extended conductor 712 to the spiral conductor 515. The second coil further includes an extended conductor 711 electrically connected to the third outer electrode 45, and a via conductor 611 connecting the extended conductor 711 to the spiral conductor 512. The connection configuration of the spiral conductors 511, 514, and 515 constituting the first coil is the same as the example illustrated in FIG. 2 except that the outer peripheral end portion of the spiral conductor 511 is extended to the outer peripheral edge of the insulating layer 312 so as to be electrically connected to the second outer electrode 44. In the same manner, the connection configuration of the spiral conductors 512, 513, and 516 constituting the second coil is the same as the example illustrated in FIG. 2 except that the outer peripheral end portion of the spiral conductor 516 is extended to the outer peripheral edge of the insulating layer 317 so as to be electrically connected to the fourth outer electrode 46.

In the structural example illustrated in FIG. 2, the first spiral conductor constituting the first coil corresponds to the spiral conductor 504, the second spiral conductor corresponds to the spiral conductor 505, and the third spiral conductor corresponds to the spiral conductor 501. Furthermore, the fourth spiral conductor constituting the second coil corresponds to the spiral conductor 503, the fifth spiral conductor corresponds to the spiral conductor 502, and the sixth spiral conductor corresponds to the spiral conductor 506. Similarly, in the structural example illustrated in FIG. 3, the first spiral conductor constituting the first coil corresponds to the spiral conductor 514, the second spiral conductor corresponds to the spiral conductor 515, and the third spiral conductor corresponds to the spiral conductor 511. Furthermore, the fourth spiral conductor constituting the second coil corresponds to the spiral conductor 513, the fifth spiral conductor corresponds to the spiral conductor 512, and the sixth spiral conductor corresponds to the spiral conductor 516. Although the distances between the spiral conductors are described below by using the structure illustrated in FIG. 2 as an example, the description below equally applies to the structural example illustrated in FIG. 3.

Figure 4:
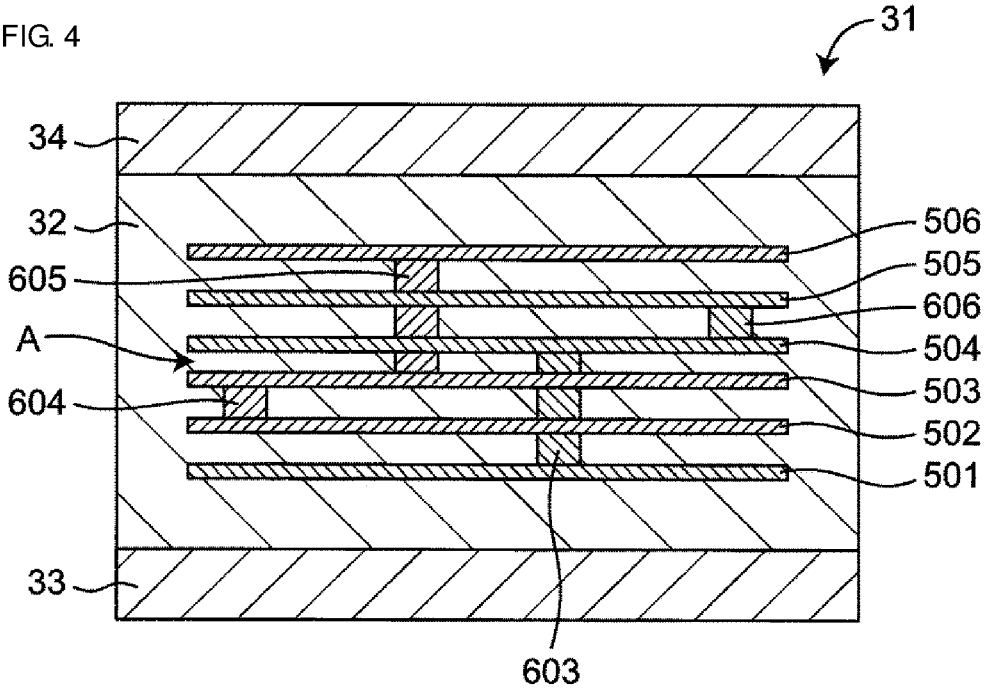
FIG. 4 is a schematic cross-sectional view of the common mode choke coil of the first embodiment at a section parallel to the stacking direction.

A section taken in parallel to the stacking direction of the common mode choke coil of the first embodiment is schematically illustrated in FIG. 4. As illustrated in FIG. 4, in the stacking direction of the multilayer body 31, the first spiral conductor 504 is adjacent to the second spiral conductor 505 and the fourth spiral conductor 503, and the fourth spiral conductor 503 is adjacent to the first spiral conductor 504 and the fifth spiral conductor 502.

Among the distances between the spiral conductors adjacent in the stacking direction of the multilayer body 31, the distance between the first spiral conductor 504 and the fourth spiral conductor 503 (indicated by reference sign A in FIG. 4) is smaller than other distances. By setting the distance between the first spiral conductor 504 and the fourth spiral conductor 503 to be smaller than other distances, the common mode impedance can be increased, and the cut-off frequency can be increased. It should be noted that, among the distances between the spiral conductors adjacent in the stacking direction of the multilayer body 31, the distances other than the distance between the first spiral conductor 504 and the fourth spiral conductor 503 may be simply referred to as "other distances". Here, when, among the distances between the spiral conductors adjacent in the stacking direction of the multilayer body 31, the distances other than the distance between the first spiral conductor 504 and the fourth spiral conductor 503 are not all the same, the phrase "the distance between the first spiral conductor and the fourth spiral conductor is smaller than other distances" means that the distance between the first spiral conductor and the fourth spiral conductor is smaller than the smallest distance among these "other distances".

Figure 5:
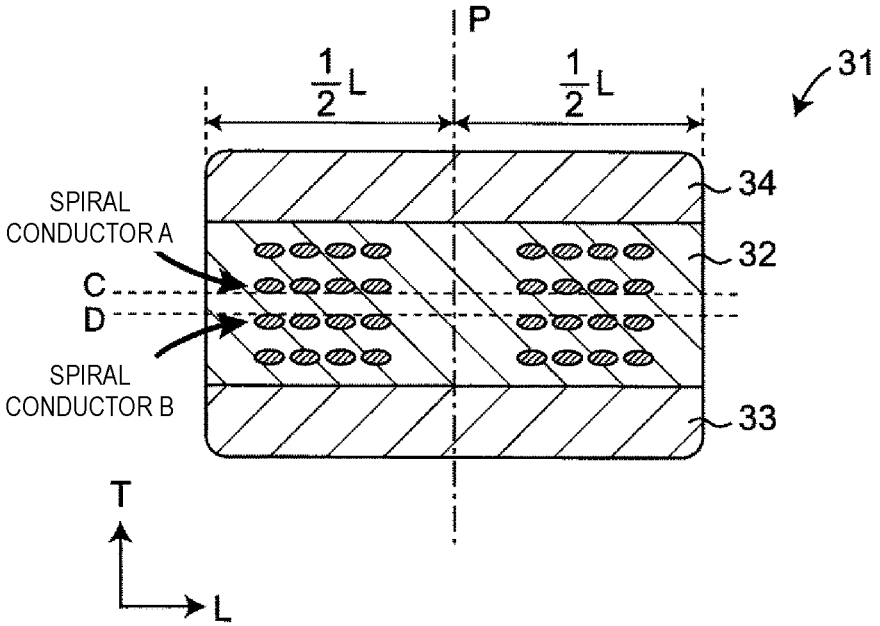
FIG. 5 is a schematic diagram illustrating a method for measuring the distance between adjacent spiral conductors.

The distance between the adjacent spiral conductors can be measured by the following method. First, a sample of the common mode choke coil 30 is positioned upright and is surrounded by a resin to immobilize. At this stage, the LT surface (for example, the side surface 47 or 48) is exposed. Using a polisher, the sample is polished to a depth of about ½ of the width W in the W direction so as to expose a section (LT section) parallel to the LT surface. Subsequently, in order to remove sagging of the coil conductors caused by polishing, ion milling (ion milling system IM 4000 produced by Hitachi High-Technologies Corporation) is used to polish the surface. The resulting polished surface of the sample is photographed with a digital microscope (VHX-6000 produced by Keyence Corporation). As illustrated in FIG. 5, a perpendicular line P substantially bisecting the length L of the multilayer body 31 is drawn in the photograph thus taken, a horizontal line C extending in the L direction and connecting the lower ends of one (spiral conductor A) of the adjacent two spiral conductors to be measured is drawn, and a horizontal line D that connects the upper ends of the other one (spiral conductor B) of the adjacent two spiral conductors is drawn. The distance between the horizontal line C and the horizontal line D is measured along the perpendicular line P, and this distance is assumed to be the distance between the adjacent spiral conductors A and B. Note that, although the cross-sectional shape of the spiral conductor is substantially elliptical in FIG. 5, the cross-sectional shape of the spiral conductor is not limited to the shape illustrated in FIG. 5.

As described below, existing common mode choke coils tend to have low cut-off frequencies when the common mode impedance is increased, and it has been difficult to achieve both a high common mode impedance and a high cut-off frequency. A conceivable approach to increasing the common mode impedance is to decrease the distances between the spiral conductors. However, decreasing the distances between the spiral conductors increases the stray capacitance between the primary coil and the secondary coil, and a high cut-off frequency cannot be achieved.

In the common mode choke coil of this embodiment, the coupling between the primary coil and the secondary coil (first coil and the second coil) is strongest between the first spiral conductor 504 and the fourth spiral conductor 503. Thus, decreasing the distance between spiral conductors in the region where the coupling between the primary coil and the secondary coil is strongest further strengthens the coupling between the primary coil and the secondary coil, and the cut-off frequency can be increased. Meanwhile, by relatively increasing distances between other spiral conductors in the regions where the coupling between the primary coil and the secondary coil is relatively weak, the stray capacitance between the primary coil and the secondary coil can be reduced while suppressing degradation of the coupling between the coils, and thus, the cut-off frequency can be increased. In this manner, the common mode choke coil of this embodiment can achieve both a high common mode impedance and a high cut-off frequency.

The distance between the first spiral conductor 504 and the fourth spiral conductor 503 is preferably 2 μm or more smaller than other distances. By setting the distances between the spiral conductors as such, the cut-off frequency can be made even higher.

In a preferred embodiment, the distance between the first spiral conductor 504 and the fourth spiral conductor 503 is 2 μm or more and 30 μm or less (i.e., from 2 μm to 30 μm), and other distances are 4 μm or more and 32 μm or less (i.e., from 4 μm to 32 μm). By setting the distances between the spiral conductors as such, a satisfactory filling ratio can be ensured for the via conductors that connect the spiral conductors to one another, and the short-circuiting risk caused by diffusion of the conductor material (such as Ag) constituting the via conductors into the glass ceramic layer can be reduced.

Figure 6:
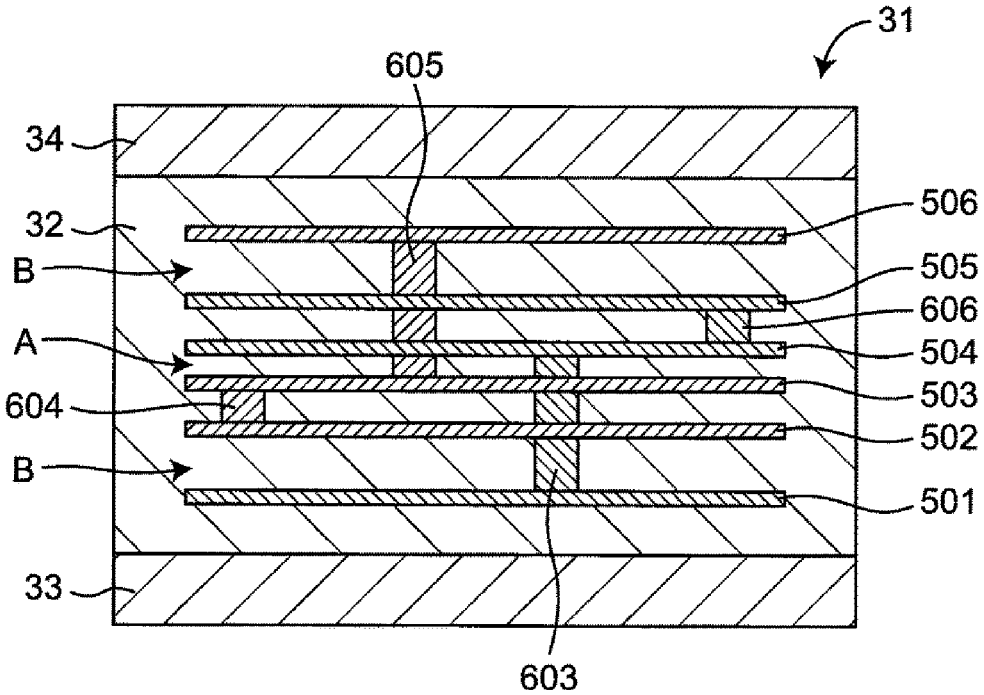
FIG. 6 is a schematic cross-sectional view of a modification example of the common mode choke coil of the first embodiment at a section parallel to the stacking direction.

A section taken in parallel to the stacking direction of a modification example of the common mode choke coil of the first embodiment is schematically illustrated in FIG. 6. As illustrated in FIG. 6, among the distances between the spiral conductors adjacent in the stacking direction of the multilayer body 31, the distance between at least one of the spiral conductors 501 and 506 located in two ends in the stacking direction and the spiral conductor 502 and/or spiral conductor 505 adjacent to the spiral conductor 501 and/or spiral conductor 506 is preferably larger than other distances. Note that in the structure illustrated in FIG. 6, the distance (indicated by reference sign B) between the spiral conductor 501 and the spiral conductor 502 and the distance (indicated by reference sign B) between the spiral conductor 505 and the spiral conductor 506 are both larger than other distances. The regions between the spiral conductors located in two ends in the stacking direction and the spiral conductors adjacent to these spiral conductors are regions where the coupling between the primary coil and the secondary coil is weakest. Thus, by increasing the distances between the spiral conductors in these regions, the stray capacitance between the primary coil and the secondary coil can be decreased while suppressing degradation of coupling between the coils, and the cut-off frequency can be made even higher.

Among the distances between the spiral conductors adjacent in the stacking direction of the multilayer body 31, the distance between at least one of the spiral conductors 501 and 506 located in two ends in the stacking direction and the spiral conductor 502 and/or spiral conductor 505 adjacent to the spiral conductor 501 and/or spiral conductor 506 is preferably 2 μm or more larger than other distances. By setting the distances between the spiral conductors as such, degradation of the coupling between the coils can be further suppressed, the stray capacitance between the primary coil and the secondary coil can be further decreased, and the cut-off frequency can be made even higher.

In a preferred embodiment, among the distances between the spiral conductors adjacent in the stacking direction of the multilayer body 31, the distance between the first spiral conductor 504 and the fourth spiral conductor 503 is 2 μm or more and 28 μm or less (i.e., from 2 μm to 28 μm), the distance between at least one of the spiral conductors 501 and 506 located in two ends in the stacking direction and the spiral conductor 502 and/or spiral conductor 505 adjacent to the spiral conductor 501 and/or spiral conductor 506 is 6 μm or more and 32 μm or less (i.e., from 6 μm to 32 μm), and other distances are 4 μm or more and 30 μm or less (i.e., from 4 μm to 30 μm). By setting the distances between the spiral conductors as such, a satisfactory filling ratio can be ensured for the via conductors that connect the spiral conductors to one another, and the short-circuiting risk caused by diffusion of the conductor material (such as Ag) constituting the via conductors into the glass ceramic layer can be reduced.

Next, a method for manufacturing a common mode choke coil is described below; however, the method for manufacturing the common mode choke coil of this embodiment is not limited to the method described below.

Preparation of Glass Ceramic Sheets

A borosilicate glass powder having a particular composition is prepared. Particular amounts of quartz ($SiO_2$), forsterite ($2MgO{\cdot}SiO_2$) and alumina ($Al_2O_3$), etc., are added thereto to serve as a filler, and the resulting mixture is placed in a pot mill together with an organic binder, an organic solvent, a plasticizer, and partially stabilized zirconia (PSZ) balls, and the resulting mixture is mixed and pulverized. The obtained slurry is formed into sheets by a doctor blade method or the like, and rectangular glass ceramic sheets are punched out from the obtained sheets.

Preparation of Ferrite Sheets

Ferrite raw materials, such as $Fe_2O_3$, ZnO, CuO, and NiO, are weighed to yield a particular composition, and the weighed materials are placed in a pot mill together with pure water and PSZ balls. The resulting mixture is wet-mixed and pulverized, dried by evaporation, and calcined for a particular length of time at a temperature of 700° C. or higher and 800° C. or lower to prepare a calcined powder.

Next, the calcined powder is placed in a pot mill again together with an organic binder, an organic solvent, and PSZ balls, and the resulting mixture is mixed and pulverized. The obtained slurry is formed into sheets by a doctor blade method or the like, and rectangular ferrite sheets are punched out from the obtained sheets.

Preparation of Common Mode Choke Coil

Via holes are formed at particular positions in the glass ceramic sheets by laser irradiation, and the via holes are filled with a conductive paste (Ag paste or the like). Next, spiral conductors and extended conductors are formed by screen printing using a conductive paste. The conductive paste may contain a metal oxide such as $Al_2O_3$. The content of the metal oxide, such as $Al_2O_3$, is preferably about 0.02 wt % or more and 0.2 wt % or less (i.e., from about 0.02 wt % to 0.2 wt %) relative to the total weight of the metal, such as Ag, and the metal oxide. The method for forming the spiral conductors and the extended conductors is not limited to screen printing and may be formed by plating, for example.

The glass ceramic sheets (in other words, the insulating layers) are stacked in the order illustrated in FIG. 2, a particular number of the ferrite sheets are stacked above and under the resulting stack of the glass ceramic sheets, and, in some cases, a particular number of glass ceramic sheets are further stacked above and under the resulting stack of the glass ceramic sheets and the ferrite sheets. The obtained stack is press-bonded under heating and is cut with a dicer or the like into individual pieces. As a result, a multilayer formed body is prepared. Press bonding may be performed by a process such as isostatic pressing. Next, the multilayer formed body is heated to 350° C. or higher and 500° C. or lower (i.e., from 350° C. to 500° C.) in a firing furnace in an air atmosphere to perform debinding, and then fired at a temperature of 850° C. or higher and 920° C. or lower (i.e., from 850° C. to 920° C.) to obtain a multilayer body. The multilayer body is subjected to a barrel treatment, an outer electrode conductive paste containing a Ag powder and a particular amount of glass frit is applied to a particular position of the multilayer body and fired at a temperature of about 900° C. so as to form a base electrode. Plating is performed on the base electrode by using Ni, Cu, Sn, and the like. For example, a Ni layer and a Sn layer may be sequentially formed on the base electrode by plating. As a result, a common mode choke coil is obtained.

Second Embodiment

Figure 7:
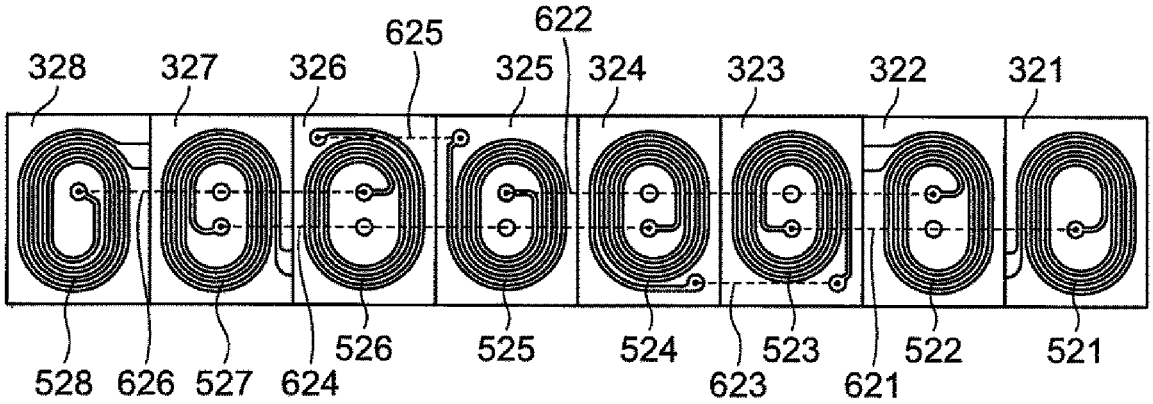
FIG. 7 is a schematic diagram illustrating one example of an internal structure of a multilayer body in a common mode choke coil of a second embodiment.

Next, a common mode choke coil according to a second embodiment of the present disclosure is described below. One example of an internal structure of a multilayer body in the common mode choke coil of the second embodiment is schematically illustrated in FIG. 7. The common mode choke coil of the second embodiment differs from the common mode choke coil of the first embodiment in that the first coil further includes a seventh spiral conductor and the second coil further includes an eighth spiral conductor. The structures related to these differences are described below. For other features, the common mode choke coil of the second embodiment has similar structures as those of the first embodiment, and the descriptions therefor are omitted. The common mode choke coil according to the second embodiment has a high common mode impedance and a high cut-off frequency, as with the common mode choke coil of the first embodiment.

The glass ceramic layer in the structure illustrated in FIG. 7 has a multilayer structure constituted by a stack of insulating layers that include eight insulating layers 321 to 328. The insulating layers may each be formed of a single insulator sheet, or multiple insulator sheets may be stacked to serve as one insulating layer. The insulating layers 321 to 328 are stacked in this order from the bottom. Spiral conductors 521 to 528 are respectively formed on the insulating layers 322 to 327. The spiral conductors 521 to 528 each have an inner peripheral end portion, which is located relatively near the center of the corresponding one of the insulating layers 321 to 328, and an outer peripheral end portion, which is located relatively near the outer periphery. The spiral conductors 521 to 528 are actually formed to extend along the interfaces between the adjacent insulating layers 321 to 328; however, for the purpose of the description, the spiral conductors 521 to 528 are assumed to be disposed on the insulating layers 321 to 328.

A first coil and a second coil are formed inside the multilayer body, more specifically, inside the glass ceramic layer. The first coil includes a first spiral conductor, a second spiral conductor, a third spiral conductor, and a seventh spiral conductor that are connected to one another through via conductors in the stacking direction of the multilayer body. The second coil includes a fourth spiral conductor, a fifth spiral conductor, a sixth spiral conductor, and an eighth spiral conductor that are connected to one another through via conductors in the stacking direction of the multilayer body. In the structure illustrated in FIG. 7, the first coil includes spiral conductors 521, 523, 524, and 527 and via conductors 621, 623, and 624, and the second coil includes spiral conductors 522, 525, 526, and 528 and via conductors 622, 625, and 626. The outer peripheral end portion of the spiral conductor 521 of the first coil is extended as far as the outer peripheral edge of the insulating layer 321 so as to be electrically connected to the first outer electrode, and the outer peripheral end portion of the spiral conductor 527 is extended as far as the outer peripheral edge of the insulating layer 327 so as to be electrically connected to the second outer electrode. The outer peripheral end portion of the spiral conductor 522 of the second coil is extended as far as the outer peripheral edge of the insulating layer 322 so as to be electrically connected to the fourth outer electrode, and the outer peripheral end portion of the spiral conductor 528 is extended as far as the outer peripheral edge of the insulating layer 328 so as to be electrically connected to the third outer electrode.

Figure 8:
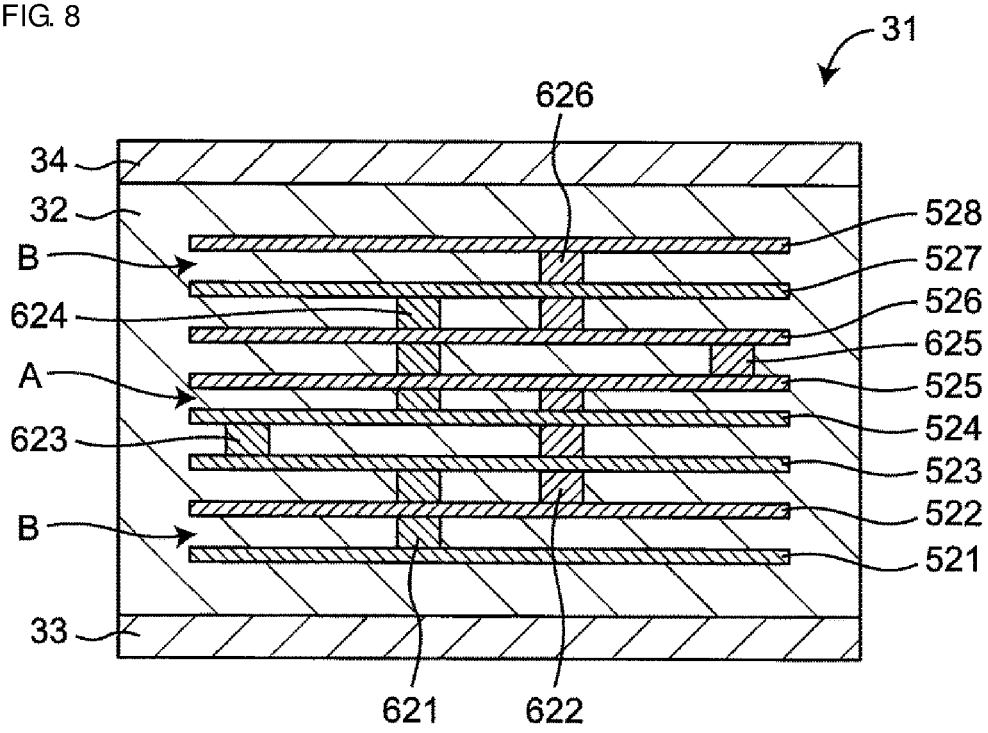
FIG. 8 is a schematic cross-sectional view of the common mode choke coil of the second embodiment at a section parallel to the stacking direction.

A section taken in parallel to the stacking direction of the common mode choke coil of the second embodiment is schematically illustrated in FIG. 8. As illustrated in FIG. 8, in the stacking direction of the multilayer body 31, the first spiral conductor 524 is adjacent to the second spiral conductor 523 and the fourth spiral conductor 525, and the fourth spiral conductor 525 is adjacent to the first spiral conductor 524 and the fifth spiral conductor 526.

Among the distances between the spiral conductors adjacent in the stacking direction of the multilayer body 31, the distance between the first spiral conductor 524 and the fourth spiral conductor 525 (indicated by reference sign A in FIG. 8) is smaller than other distances. By setting the distance between the first spiral conductor 524 and the fourth spiral conductor 525 to be smaller than other distances, the common mode impedance can be increased, and the cut-off frequency can be increased. It should be noted that, among the distances between the spiral conductors adjacent in the stacking direction of the multilayer body 31, the distances other than the distance between the first spiral conductor 524 and the fourth spiral conductor 525 may be simply referred to as "other distances".

In the structure illustrated in FIG. 8, among the distances between the spiral conductors adjacent in the stacking direction of the multilayer body 31, the distance (indicated by reference sign B) between at least one of the spiral conductors 521 and 528 located in two ends in the stacking direction and the spiral conductor 522 and/or spiral conductor 527 adjacent to the spiral conductor 521 and/or spiral conductor 528 is preferably larger than other distances. Thus, by setting the distances between the spiral conductors as such, the stray capacitance between the primary coil and the secondary coil can be decreased while suppressing degradation of the coupling between the coils, and the cut-off frequency can be made even higher.

Although common mode choke coils related to the present disclosure are described above by taking, as examples, structures in which the first coil and the second coil each include three or four layers of spiral conductors, the present disclosure is not limited to the structures described above. The first coil and the second coil may each include 5 or more layers of spiral conductors, and in such a case also, a common mode choke coil that has a high common mode impedance and a high cut-off frequency can be obtained.

EXAMPLE 1

Common mode choke coils of Examples 1 to 10 were prepared by the procedure described below.

Preparation of Glass Ceramic Sheets

A glass powder having a composition of 78 wt % $SiO_2$, 20 wt % $B_2O_3$, and 2 wt % $K_2O$ with an average particle diameter of 1.0 μm was prepared as the borosilicate glass powder. A quartz powder and an alumina powder having an average particle diameter of 0.5 μm or more and 1.5 μm or less (i.e., from 0.5 μm to 1.5 μm) were prepared as the filler. The raw materials were weighed and mixed so as to yield a composition containing 85 wt % glass powder, 12 wt % quartz powder, and 3 wt % alumina powder, and the resulting mixture was placed in a pot mill together with an organic binder such as a polyvinyl butyral resin, an organic solvent such as ethanol and toluene, a plasticizer, and PSZ balls. The resulting mixture was thoroughly mixed and pulverized to prepare a glass ceramic slurry. The slurry was formed into sheets by a doctor blade method to prepare glass ceramic sheets.

Preparation of Ferrite Sheets

Raw materials were weighed so that the ferrite composition was 48 mol % $Fe_2O_3$, 26 mol % ZnO, 8 mol % CuO, and the balance being NiO. The weighed materials were placed in a pot mill together with pure water and balls such as PSZ balls, and the resulting mixture was thoroughly wet-mixed and pulverized, dried by evaporation, and calcined for a particular length of time at a temperature of 700° C. As a result, a calcined powder was obtained. The calcined powder was placed again in a pot mill together with an organic binder such as a polyvinyl butyral organic binder, an organic solvent such as ethanol and toluene, and PSZ balls. The resulting mixture was thoroughly mixed and pulverized to prepare a ferrite slurry. The slurry was formed into sheets by a doctor blade method to prepare ferrite sheets.

Preparation of Common Mode Choke Coil

Via holes were formed at particular positions in the glass ceramic sheets by laser irradiation, and the via holes were filled with a conductive paste (Ag paste). Next, spiral conductors were formed by screen printing. A paste containing 0.1 wt % of $Al_2O_3$ powder relative to the total weight of the $Al_2O_3$ powder and Ag powder was used as the conductive paste. The glass ceramic sheets were stacked in the order illustrated in FIG. 7, a particular number of the ferrite sheets were stacked above and under the resulting stack of the glass ceramic sheets, and, a particular number of glass ceramic sheets were further stacked above and under the resulting stack of the glass ceramic sheets and the ferrite sheets. The obtained stack was press-bonded under heating and was cut with a dicer or the like into individual pieces. As a result, a multilayer formed body was prepared. The thicknesses of the glass ceramic sheets were set so that the distances between the spiral conductors were as indicated in Table 1. In Table 1 and Table 2 below, the "distance between spiral conductors at the center" means the distance between the first spiral conductor and the fourth spiral conductor, and is a distance of the portion indicated by reference sign A in FIG. 8.

Next, this multilayer formed body was heated to 350° C. or higher and 500° C. or lower (i.e., from 350° C. to 500° C.) in a firing furnace in an air atmosphere to perform debinding, and then fired at a temperature of 900° C. to obtain a multilayer body.

The multilayer body was subjected to a barrel treatment, an outer electrode conductive paste containing a Ag powder and a particular amount of glass frit was applied to a particular position and fired at a temperature of about 800° C. so as to form a base electrode. Common mode choke coils of Examples 1 to 10 were prepared by sequentially forming a Ni layer and a Sn layer on the base electrode. The dimensions of the common mode choke coil were length L: 0.65 mm, width W: 0.50 mm, and thickness T: 0.30 mm.

For the obtained common mode choke coils, an impedance analyzer "E4991A" produced by Agilent Technologies was used to measure the common mode impedance at a temperature of 20±3° C. and a frequency of 100 MHz. A network analyzer "E5071B" produced by Agilent Technologies was used to measure the cut-off frequency at a temperature of 20±3° C. The results are shown in Table 1 and FIG. 9. In Table 1, the asterisked samples are comparative examples.

TABLE 1

| Example | 1 | 2 | 3 | 4 | 5 | 6 | 7* | 8* | 9* | 10* |
|---|---|---|---|---|---|---|---|---|---|---|
| Distance between spiral conductors at the center (μm) | 13 | 12 | 10 | 8 | 6 | 4 | 14 | 18 | 10 | 6 |
| Other distances (μm) | 14 | 14 | 14 | 14 | 14 | 14 | 14 | 18 | 10 | 6 |
| Common mode impedance Zc (Ω) | 49 | 50 | 50 | 51 | 51 | 52 | 49 | 42 | 59 | 73 |
| Cut-off frequency fc (GHz) | 3.7 | 3.8 | 4 | 4.3 | 4.6 | 5.1 | 3.6 | 4.4 | 3 | 2.4 |

EXAMPLE 2

Common mode choke coils of Examples 11 to 18 were prepared by the same procedure as in Example 1 except that the distances between the spiral conductors were set to the values shown in Table 2, and the common mode impedance and the cut-off frequency were measured. The results are shown in Table 2 and FIG. 9. In Table 2 below, the "distances between spiral conductors in two end portions" means the distances between the respective spiral conductors located in two end portions in the stacking direction and the respective spiral conductors adjacent thereto, and are distances of the portions indicated by reference sign B in FIG. 8.

TABLE 2

| Example | 11 | 12 | 13 | 14 | 15 | 16 | 17 | 18 |
|---|---|---|---|---|---|---|---|---|
| Distance between spiral conductors at the center (μm) | 6 | 6 | 6 | 6 | 6 | 6 | 6 | 6 |
| Distances between spiral conductors in two end portions | 10 | 14 | 18 | 22 | 26 | 30 | 34 | 38 |
| Other distances (μm) | 14 | 14 | 14 | 14 | 14 | 14 | 14 | 14 |
| Common mode impedance Zc (Ω) | 52 | 51 | 48 | 46 | 44 | 43 | 41 | 39 |
| Cut-off frequency fc (GHz) | 3.6 | 4.6 | 5.7 | 6.0 | 5.9 | 5.8 | 5.7 | 4.8 |

Figure 9:
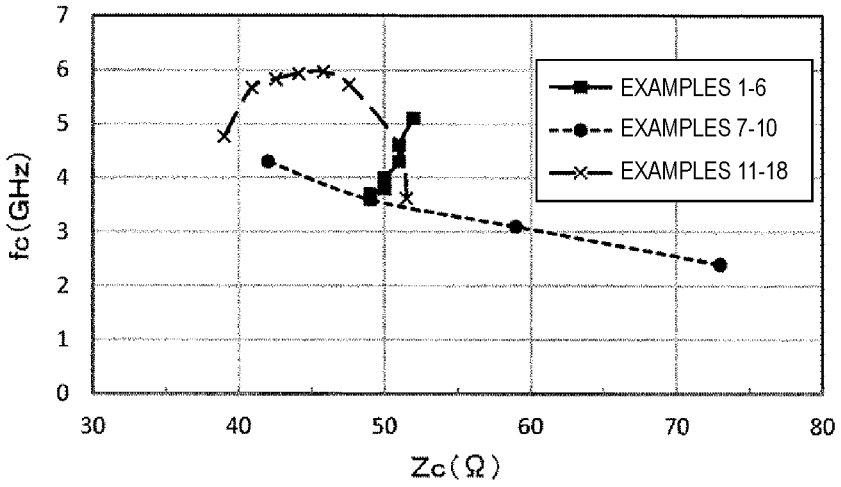
FIG. 9 is a graph showing the relationship between the common mode impedance and the cut-off frequency of the common mode choke coils of Examples.

As apparent from Tables 1 and 2 and FIG. 9, in Examples 7 to 10 in which the distances between the spiral conductors were all the same, the common mode impedance increased by decreasing the distances between the spiral conductors but the cut-off frequency decreased. In contrast, in Examples 1 to 6 in which only the distance between the first spiral conductor and the fourth spiral conductor is decreased, the common mode impedance increased with the decrease in the distance between the first spiral conductor and the fourth spiral conductor, and the cut-off frequency also increased. This tendency is completely different from the tendency observed in Examples 7 to 10, which are comparative examples, and has not been seen in existing common mode choke coils. The measurement results in Examples 11 to 18 show that, by setting the distances between the spiral conductors in the two end portions in the stacking direction and the spiral conductors adjacent thereto to be larger than other distances, the stray capacitance between the primary coil and the secondary coil can be decreased while suppressing degradation of the coupling between the coils, and the cut-off frequency can be increased.

The present disclosure includes the following nonlimiting aspects.

Aspect 1

A common mode choke coil includes a multilayer body obtained by stacking a plurality of insulating layers; a first coil and a second coil disposed inside the multilayer body; and a first outer electrode, a second outer electrode, a third outer electrode, and a fourth outer electrode disposed on outer surfaces of the multilayer body. The first outer electrode and the second outer electrode are respectively electrically connected to a first end and a second end of the first coil. The third outer electrode and the fourth outer electrode are respectively electrically connected to a first end and a second end of the second coil. The first coil includes at least a first spiral conductor, a second spiral conductor, and a third spiral conductor that are connected to one another in a stacking direction of the multilayer body through via conductors. The second coil includes at least a fourth spiral conductor, a fifth spiral conductor, and a sixth spiral conductor that are connected to one another in the stacking direction of the multilayer body through via conductors. In the stacking direction, the first spiral conductor is adjacent to the second spiral conductor and the fourth spiral conductor, and the fourth spiral conductor is adjacent to the first spiral conductor and the fifth spiral conductor, and among distances between the spiral conductors adjacent in the stacking direction, a distance between the first spiral conductor and the fourth spiral conductor is smaller than other distances.

Aspect 2

The common mode choke coil according to aspect 1, wherein the distance between the first spiral conductor and the fourth spiral conductor is 2 μm or more smaller than other distances.

Aspect 3

The common mode choke coil according to aspect 1 or 2, wherein the distance between the first spiral conductor and the fourth spiral conductor is 2 μm or more and 30 μm or less (i.e., from 2 μm to 30 μm), and other distances are 4 μm or more and 32 μm or less (i.e., from 4 μm to 32 μm).

Aspect 4

The common mode choke coil according to any one of aspects 1 to 3, wherein the first coil further includes a seventh spiral conductor, and the second coil further includes an eighth spiral conductor.

Aspect 5

The common mode choke coil according to any one of aspects 1 to 4, wherein, among the distances between the spiral conductors adjacent in the stacking direction, a distance between at least one of the spiral conductors located in two end portions in the stacking direction and the spiral conductor adjacent to the at least one spiral conductor is larger than other distances.

Aspect 6

The common mode choke coil according to aspect 5, wherein, among the distances between the spiral conductors adjacent in the stacking direction, the distance between at least one of the spiral conductors located in two end portions in the stacking direction and the spiral conductor adjacent to the at least one spiral conductor is 2 μm or more larger than other distances.

Aspect 7

The common mode choke coil according to aspect 5 or 6, wherein, among the distances between the spiral conductors adjacent in the stacking direction, the distance between the first spiral conductor and the fourth spiral conductor is 2 μm or more and 28 μm or less (i.e., from 2 μm to 28 μm), and the distance between at least one of the spiral conductors located in two end portions in the stacking direction and the spiral conductor adjacent to the at least one spiral conductor is 6 μm or more and 32 μm or less (i.e., from 6 μm to 32 μm), and other distances are 4 μm or more and 30 μm or less (i.e., from 4 μm to 30 μm).

The common mode choke coil according to an embodiment of the present disclosure has a high common mode impedance and excellent high-frequency characteristics, and thus can be widely used in high-frequency usages such as high-frequency noise rejection.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A common mode choke coil, comprising:

a multilayer body obtained by stacking a plurality of insulating layers;

a first coil and a second coil disposed inside the multilayer body, the first coil includes at least a first spiral conductor, a second spiral conductor, and a third spiral conductor that are connected to one another in a stacking direction of the multilayer body through via conductors, and the second coil includes at least a fourth spiral conductor, a fifth spiral conductor, and a sixth spiral conductor that are connected to one another in the stacking direction of the multilayer body through via conductors; and a first outer electrode, a second outer electrode, a third outer electrode, and a fourth outer electrode disposed on outer surfaces of the multilayer body, the first outer electrode and the second outer electrode are respectively electrically connected to a first end and a second end of the first coil, and the third outer electrode and the fourth outer electrode are respectively electrically connected to a first end and a second end of the second coil, wherein in the stacking direction, the first spiral conductor is adjacent to the second spiral conductor and the fourth spiral conductor, and the fourth spiral conductor is adjacent to the first spiral conductor and the fifth spiral conductor, and among distances between the spiral conductors adjacent in the stacking direction, a distance between the first spiral conductor and the fourth spiral conductor is 2 μm or more smaller than other distances.

2. The common mode choke coil according to claim 1, wherein the distance between the first spiral conductor and the fourth spiral conductor is from 2 μm to 30 μm, and other distances are from 4 μm to 32 μm.

3. The common mode choke coil according to claim 1, wherein the first coil further includes a seventh spiral conductor, and the second coil further includes an eighth spiral conductor.

4. The common mode choke coil according to claim 1, wherein, among the distances between the spiral conductors adjacent in the stacking direction, a distance between at least one of the spiral conductors located in two end portions in the stacking direction and the spiral conductor adjacent to the at least one spiral conductor is larger than other distances.

5. The common mode choke coil according to claim 4, wherein, among the distances between the spiral conductors adjacent in the stacking direction, the distance between at least one of the spiral conductors located in two end portions in the stacking direction and the spiral conductor adjacent to the at least one spiral conductor is 2 μm or more larger than other distances.

6. The common mode choke coil according to claim 4, wherein among the distances between the spiral conductors adjacent in the stacking direction, the distance between the first spiral conductor and the fourth spiral conductor is from 2 μm to 28 μm, and the distance between at least one of the spiral conductors located in two end portions in the stacking direction and the spiral conductor adjacent to the at least one spiral conductor is from 6 μm to 32 μm, and other distances are from 4 μm to 30 μm.

7. The common mode choke coil according to claim 2, wherein the first coil further includes a seventh spiral conductor, and the second coil further includes an eighth spiral conductor.

8. The common mode choke coil according to claim 2, wherein, among the distances between the spiral conductors adjacent in the stacking direction, a distance between at least one of the spiral conductors located in two end portions in the stacking direction and the spiral conductor adjacent to the at least one spiral conductor is larger than other distances.

9. The common mode choke coil according to claim 3, wherein, among the distances between the spiral conductors adjacent in the stacking direction, a distance between at least one of the spiral conductors located in two end portions in the stacking direction and the spiral conductor adjacent to the at least one spiral conductor is larger than other distances.

10. The common mode choke coil according to claim 7, wherein, among the distances between the spiral conductors adjacent in the stacking direction, a distance between at least one of the spiral conductors located in two end portions in the stacking direction and the spiral conductor adjacent to the at least one spiral conductor is larger than other distances.

11. The common mode choke coil according to claim 5, wherein among the distances between the spiral conductors adjacent in the stacking direction, the distance between the first spiral conductor and the fourth spiral conductor is from 2 μm to 28 μm, and the distance between at least one of the spiral conductors located in two end portions in the stacking direction and the spiral conductor adjacent to the at least one spiral conductor is from 6 μm to 32 μm, and other distances are from 4 μm to 30 μm.

* * * * *